United States Patent [19]

Deutsch

[11] Patent Number: 4,800,794

[45] Date of Patent: Jan. 31, 1989

[54] HARMONIC COEFFICIENT GENERATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 69,793

[22] Filed: Jul. 6, 1987

[51] Int. Cl.[4] ..... G10H 1/14; G10H 7/00

[52] U.S. Cl. ..... 84/1.21; 84/1.23; 84/1.27

[58] Field of Search ..... 84/1.01, 1.19–1.23, 84/1.27, DIG. 9

[56] References Cited

U.S. PATENT DOCUMENTS

| | | | |
|---|---|---|---|
| 4,300,432 | 11/1981 | Deutsch | 84/1.01 |
| 4,300,434 | 11/1981 | Deutsch | 84/1.27 X |
| 4,461,200 | 7/1984 | Kitagawa | 84/1.22 X |
| 4,466,325 | 8/1984 | Takauji | 84/1.22 |
| 4,502,360 | 3/1985 | Deutsch | 84/1.23 |
| 4,677,889 | 7/1987 | Deutsch | 84/1.01 |
| 4,700,603 | 10/1987 | Takauji et al. | 84/1.23 X |

*Primary Examiner*—Stanley J. Witkowski

*Attorney, Agent, or Firm*—Ralph Deutsch

[57] ABSTRACT

A keyboard operated electronic musical instrument is disclosed which has a number of tone generators each of which is assigned to an actuated keyswitch. Musical waveshapes are generated by a computation using a set of harmonic coefficients. Apparatus is described for generating the set of harmonic coefficients in response to a preselected set of increment number values wherein this set is less in number than the number of harmonic coefficients in a set. The generation of harmonic coefficients is accomplished by computing linear slope variations of groups of coefficients.

8 Claims, 5 Drawing Sheets

HARMONIC COEFFICIENT GENERATOR FOR AN ELECTRONIC MUSICAL INSTRUMENT

BACKGROUND OF THE INVENTION

1. Field of the Invention

This invention relates to musical tone synthesis and in particular is concerned with an improvement for systematically selecting tone colors.

2. Description of the Prior Art

The current trend toward the use of digital tone generation system is primarily motivated by the quest for a commercially viable musical instrument which can produce good tone characteristics and which can be implemented at a commercially acceptable cost. A flexible type of a musical tone generation system is one in which a musical waveshape is computed from a preselected set of harmonic coefficients by means of a Fourier-type of transform algorithm. Several methods can serve to obtain the set of harmonic coefficients. One technique is to perform a harmonic analysis on tones recorded from acoustic orchestral type musical instruments. A second technique is of the trial and error approach in which the individual harmonics are adjusted in magnitude until a sound is found which satisfies the listener.

The practical problem involved with the simple trial and error technique to determine usable sets of harmonic coefficients lies in the vast number of theoretical combinations possible for even a modest number of harmonic coefficients. For example, a typical digital tone generator many produce tones corresponding to a set of 32 harmonics. Each of these harmonics may have coefficient values that range from 0 DB to about −32 DB. The number of theoretical combinations of 32 harmonics varied in 1 DB step is $1.4614\times10^{48}$. If one combination is changed each second, it would take $4.7\times10^{40}$ years to try all possible combinations. Obviously this is far too much time to spend on such a tone seeking enterprise. It should be noted that not all the possible combinations provide tones that a listener would judge to be tonal distinguishable. Moreover many of the possible combinations yield essentially identical tones which differ primarily in their relative loudness.

Digital tone generators that create musical tones by computing a Fourier transform using preselected sets of harmonic coefficients are described in U.S. Pat. No. 3,809,786 entitled "Computer Organ" and in U.S. Pat. No. 4,085,644 entitled "Polyphonic Tone Synthesizer."

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is generated. The master data set comprises a set of data points which define a period of a musical waveshape.

The master data set is computed using a set of stored harmonic coefficients. After the master data set is computed, a transfer cycle is initiated during which the master data set is transferred to a plurality of note registers. There is a note register associated with each tone generator. The data stored in a note register is read out sequentially and repetitively by a note clock such that the memory address advance rate corresponds to a fixed multiple of the fundamental musical frequency associated with an actuated keyboard switch.

A subsystem is described for computing the set of harmonic coefficients using a small set of increment numbers. An adder-accumulator is used for repetitively summing the incremented numbers to create a subset of harmonic coefficients expressed in DB units corresponding to each of the increment numbers. A conversion is then made to transform the DB values to amplitude numbers for the set of harmonic coefficients.

BRIEF DESCRIPTION OF THE DRAWINGS

The detailed description of the invention is made with reference to the accompanying drawings wherein like numerals desigate like components in the figures.

DETAILED DESCRIPTION OF THE INVENTION

The present invention is directed toward a musical tone generation system in which the musical tone color, or tone spectra, is controlled by a subsystem for generating harmonic coefficients in a systematic fashion. The harmonic coefficient generating subsystem is incorporated into a muscial instrument of the type which synthesizes musical waveshapes by implementing a discrete Fourier transform algorithm. A tone generation system of this category is described in detail in U.S. Pat. No. 4,085,644 entitled "Polyphonic Tone Synthesizer." This patent is hereby incorporated by reference.

Figure 1:
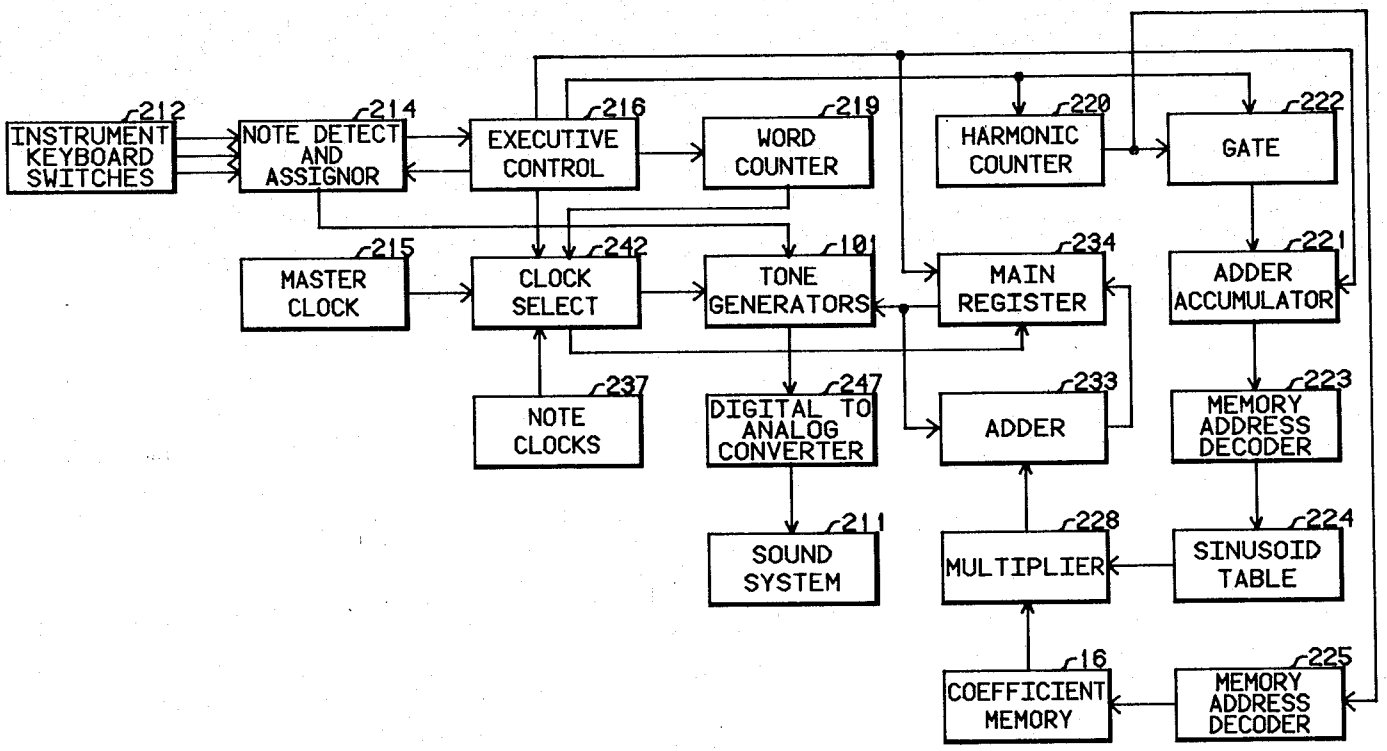
FIG. 1 is schematic diagram of a musical instrument utilizing an embodiment of the invention.

FIG. 1 shows an embodiment of the present invention which is described as an adjunct to the muscial tone generation system disclosed in the referenced U.S. Pat. No. 4,085,644. The system elements in FIG. 1 have numeric labels which are 200 plus the same system element numbers shown in the referenced patent. As described in the referenced patent, the Polyphonic Tone Synthesizer includes an array of instrument keyboard switches 212. If one or more of the keyboard switches has a switch status change and is actuated ("on" switch position), the note detect and assignor 214, encodes the detected keyboard switch having the status change to an actuated state and stores the corresponding note information for the actuated keyswitches. A tone generator, contained in the system block labeled tone generators 101, is assigned to each actuated keyswitch using information generated by the note detect and assignor 214.

A suitable configuration for a note detect and assignor subsystem is described in U.S. Pat. No. 4,022,098. This patent is hereby incorporated by reference.

When one or more keyswitches have been actuated, the executive control 216 initiates a repetitive sequence of computation cycles. During each computation cycle, a master data set is computed. The 64 data words in a master data set correspond to the amplitudes of 64 equally spaced points of one cycle of the audio waveform for a musical tone. The general rule is that the maximum number of harmonics in the audio tone spectra is no more than one-half of the number of data points in one complete waveshape period. Therefore, a master data set comprising 64 data words corresponds to a musical waveshape having a maximum of 32 harmonics.

As described in the referenced U.S. Pat. No. 4,085,644 it is desirable to be able to continuously recompute and store the master data set during a repetitive sequence of computation cycles and to load this data into note registers while the actuated keyswitches remain actuated, or depressed, on the keyboards. There is a note register associated with each tone generator contained in the system block labeled tone generators 101.

The harmonic counter 220 is initialized to its minimal, or zero, count state at the start of each computation cycle. Each time that the word counter 219 is incremented by the executive control 216 so that it returns to its minimal, or zero, count state because of its modulo counting implementation, a signal is generated by the executive control 216 which increments the count state of the harmonic counter 220. The word counter 219 is implemented to count modulo 64 which is the number of data words comprising the master data set. The harmonic counter 220 is implemented to count modulo 32. This number corresponds to the maximum number of harmonics consistent with a master data set comprising 64 data words.

At the start of each computation cycle, the accumulator in the adder-accumulator 221 is initialized to a zero value by the executive control 216. Each time that the word counter 219 is incremented, the adder-accumulator 221 adds the current count state of the harmonic counter 202 to the sum contained in the accumulator. This addition is implemented to be modulo 64.

The content of the accumulator in the adder-accumulator 221 is used by the memory address decoder 223 to read out trigonometric sinusoid values from the sinusoid table 224. The sinusoid table 224 is advantageously implemented as a read only memory (ROM) storing values of the trigonometric function $\sin(2\pi\phi/64)$ for $0 \leqq \phi \leqq 64$ at intervals of D. D is a table resolution constant.

The memory address decoder 225 reads out harmonic coefficient values stored in the coefficient memory 16 in response to the count state of the harmonic counter 220. The harmonic coefficient values are generated in a manner described below.

The multiplier 228 generates the product value of the trigonometric sinusoid value read out from the sinusoid table 224 and the value of the harmonic coefficient read out from the coefficient memory 16. The generated product value formed by the multiplier 228 is furnished as one input to the adder 233.

The contents of the main register 234 are initialized to a zero value at the start of each computation cycle. Each time that the word counter 219 is incremented, the content of the main register 234, at an address corresponding to the count state of the word counter 219, is read out and furnished as a second input to the adder 233. The sum of the two input date words to the adder 233 are stored in the main register 234 at a memory address location equal, or corresponding, to the count state of the word counter 219. After the word counter 219 has been cycled for 32 complete cycles of 64 counts, the main register 234 will contain the master data set which comprises a complete period of a musical waveshape having a spectral content determined by the set of harmonic coefficients stored in the coefficient memory 16.

Following each computation cycle in the repetitive sequence of computation cycles, a transfer cycles in initiate and executed. During a transfer cycle the master data set stored in the main register 234 is copied out and stored in a set of note registers. There is a note register associated with each of the tone generators contained in the system block labeled tone generators 101.

The master data set stored in each of the note registers is read out sequentially and repetitively in respones to a note clock which is associated with each one of the tone generators contained in the system block labeled tone generators 101.

The data words read out from the note registers is transformed into an audible musical sound by means of the combination of the digital-to-analog converter 247 and the sound system 211. The sound system 211 contains a conventional amplifier and speaker combination for producing audible sounds.

The underlying principal for the harmonic coefficient generating system is a division of the entire set of harmonic coefficients into several contiguous groups of harmonic coefficients. Within each one of these groups, the harmonic coefficients are generated in a linear fashion using either a positive or negative slope. As an illustrative, but not a limiting or restrictive condition, if the tone generation system has the capability of a maximum of 32 harmonics, the harmonic coefficients can be grouped in four contiguous groups each of which contains eight harmonic coefficients.

Figure 2:
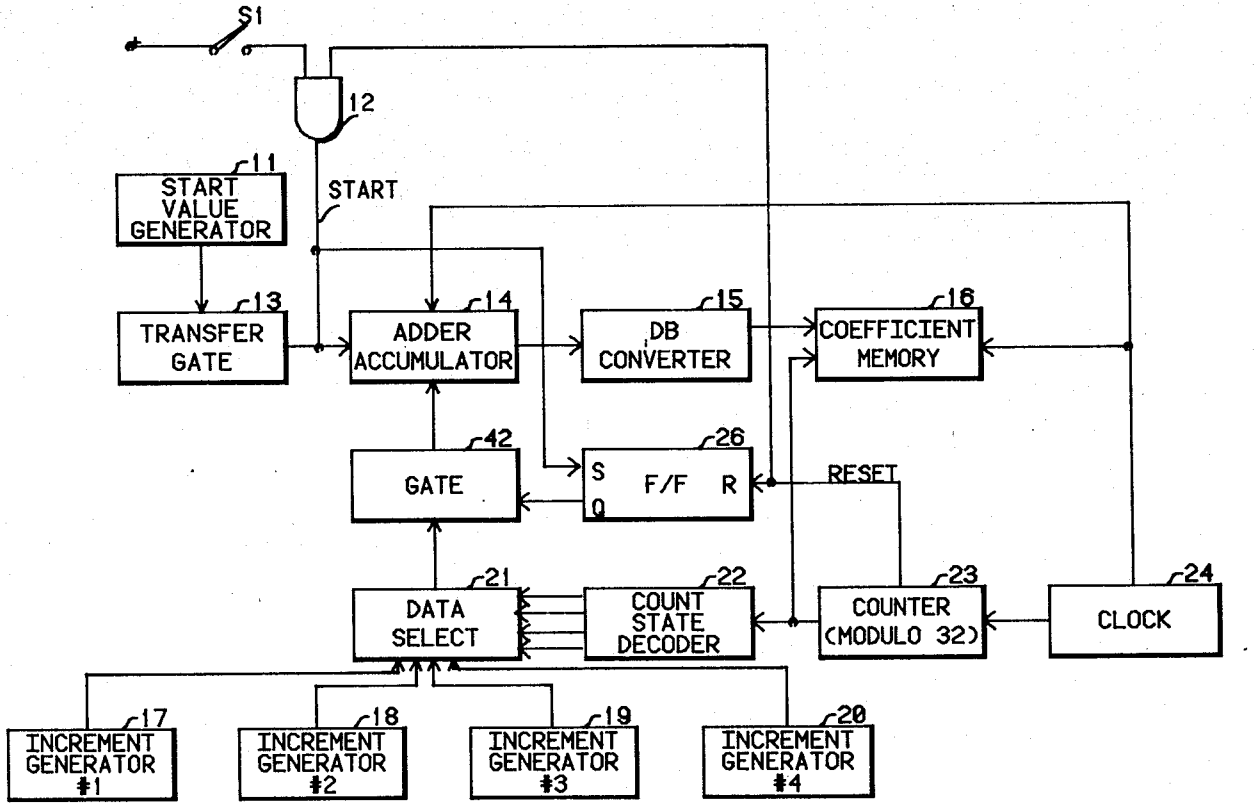
FIG. 2 is schematic diagram of an embodiment of the invention.

FIG. 2 illustrates an embodiment of the present invention for a system of generating a set of harmonic coefficients using a configuration of four groups each of which contains eight harmonic coefficients.

The start value generator 11 is used to supply the harmonic coefficient corresponding to the harmonic number 1 which is associated with the fundamental of the generated musical tone. This start harmonic coefficient is expressed in DB units. Therefore a common start harmonic coefficient value is a binary number corresponding to the decimal value of "0". The start value generator 11 can be implemented in various ways such as a conventional digital data input terminal, a binary data selection switch, or a number stored in a register.

The clock 24 provides a sequence of timing signals. The counter 23 is implemented to count these timing signals modulo 32. The modulo number is equal to the total number of harmonic coefficients generated by the subsystem shown in FIG. 2. The counter 23 generates a RESET signal each time that it is incremented so that it returns to its minimal, or zero count state.

The operation of generating a set of harmonic coefficients is started by closing the switch S1. When switchh S1 is closed and a RESET signal is generated by the counter 23, the AND-gate 12 creates a binary "1" logic state START signal is generated. In response to the START signal, the transfer gate 13 transfers the start harmonic coefficient furnished by the start value generator 11 to an accumulator contained in the adder-accumulator 14.

The adder-accumulator 14 is implemented as a numeric limiting device such that it is initizlized to a zero value and its maximum value is limited to a binary value of 11111 corresponding to the decimal value of 31. The accumulator in the adder-accumulator 14 is reset to its minimal, or zero, value in response to the START signal created by the AND-gate 12.

For convenience, the positive content of the accumulator in the adder-accumulator is interpreted as a negative value since all the harmonic coefficients are really expressed as negative DB values.

The set of increment generators 17–20 are used to furnish increment numbers which determine the slope of the harmonic coefficients, expressed in DB, for each of the four groups, or segments, of harmonic coefficients. The increment numbers can be chosen as either positive or negative numbers expressed in a binary numeric digital format.

The incrementer generators 17–20 can be implemented in various ways such as a conventional digital data input terminal, binary data selection switches, or numbers stored in registers.

The count state decoder 22 decodes the count states of the counter 23 onto four data select lines. The details of the count state decoder 22 are described below.

In response to signals on the four data select lines the data select 21 selects the increment number provided by the increment generator #1 17 for the count states 0–7 of the counter 23, it selects the increment number provided by the increment generator #2 18 for the count states 8–15 of the counter 23, it selects the increment number provided by the increment generator #3 19 for the count states 16–23 of the counter 23, and, it selects the increment number provided by the increment generator #4 20 for the count states 24–31 of the counter 23.

The flip-flop 26 is reset in response to the RESET signal generated by the counter 23. The flip-flop 26 is set in response to the START signal generated by the AND-gate 12 so that its output signal state is a logic signal Q="1". In response to the state Q="1", the gate 42 transfers the increment number chosen by the data select 21 to be added to the contents of the accumulator in the adder-accumulator 14. These additions are timed by the timing signals furnished by the clock 24.

When the counter 23 returns to its minimal count state because of its modulo counting implementation the RESET signal. In reponse to the RESET signal, the flip-flop 26 is reset so that its output signal state is the binary value Q="0". The Q="0" signal state inhibits the gate 42 from transferring its input data to the adder-accumulator 14 and thereby terminates the generation of a complete set of 32 harmonic coefficients.

The DB converter 15 is used to convert the content of the adder in the adder-accumulator 14 into harmonic coefficient values. The DB converter 15 functions as a level conversion means. Advantageously the DB converter can be implemented as a read-only addressable memory (ROM). The data values $A_i$ stored in the ROM are computed from the relation $$A_i = \exp(0.11529\ DB_i) \qquad \text{Eq. 1}$$

where $DB_i$ is the DB value for the harmonic number i.

The harmonic coefficient values, in amplitude units, are stored in the coefficient memory 16 address locations i corresponding to the count state of the counter 23.

Figure 3:
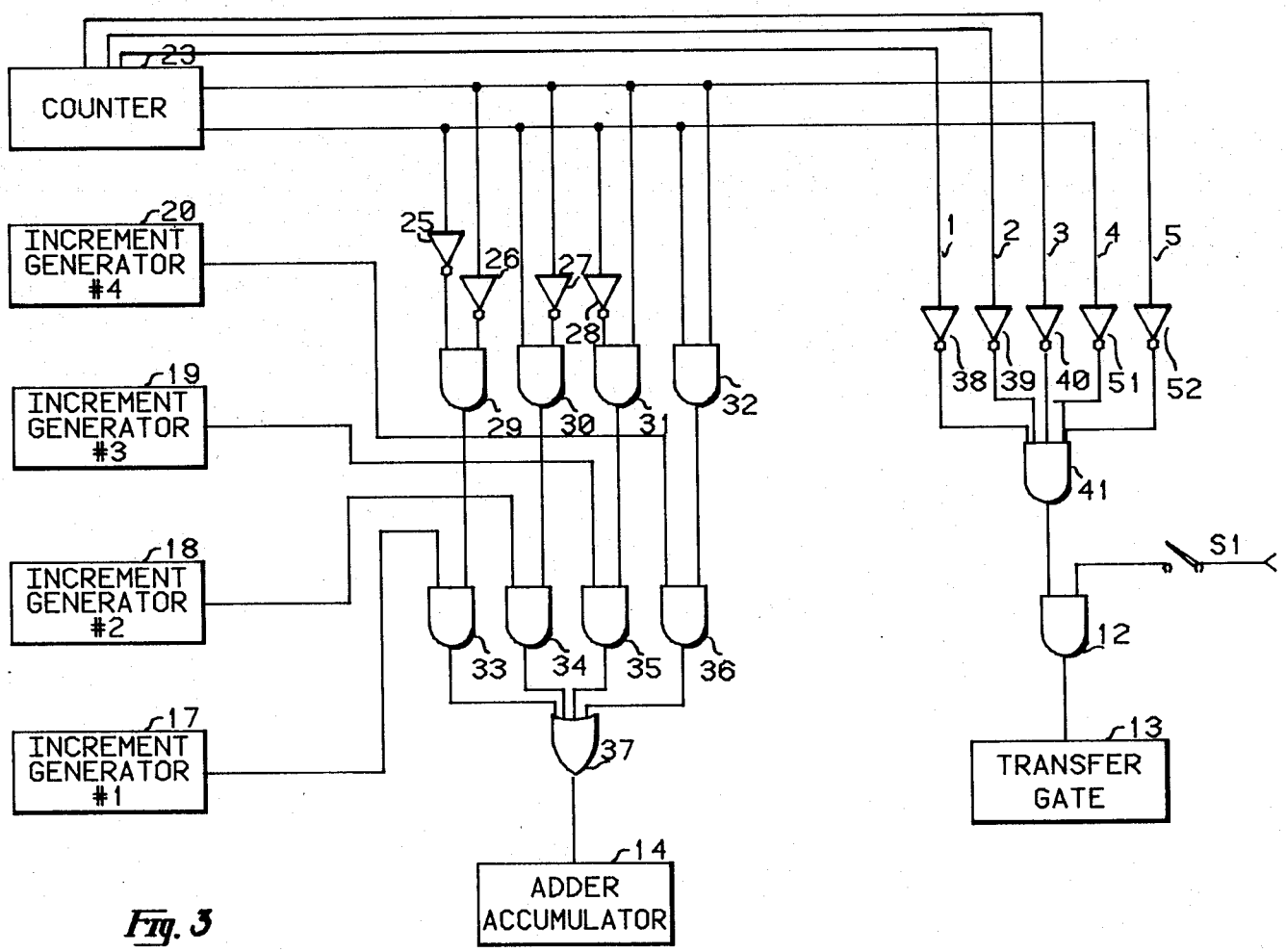
FIG. 3 is a schematic diagram of count state decoder 21 and the data select 21.

The detailed logic for an implementation of the count state decoder 22 and the data select 21 is shown in FIG. 3. The binary states of the counter 23 are words having 5 bits. The LSB (least significant bit) is numbered "1" and the MSB (Most Significant Bit) is numbered "5". Table 1 lists the binary words for the 32 count states of the counter 23.

TABLE 1

| Count State | Binary Word |
|---|---|
| 0 | 00000 |
| 1 | 00001 |
| 2 | 00010 |
| 3 | 00011 |
| 4 | 00100 |
| 5 | 00101 |
| 6 | 00110 |
| 7 | 00111 |
| 8 | 01000 |
| 9 | 01001 |
| 10 | 01010 |
| 11 | 01011 |
| 12 | 01100 |
| 13 | 01101 |
| 14 | 01110 |
| 15 | 11111 |
| 16 | 10000 |
| 17 | 10001 |
| 18 | 10010 |
| 19 | 10011 |
| 20 | 10100 |
| 21 | 10101 |
| 22 | 10110 |
| 23 | 10111 |
| 24 | 11000 |
| 25 | 11001 |
| 26 | 11010 |
| 27 | 11011 |
| 28 | 11100 |
| 29 | 11101 |
| 30 | 11110 |
| 31 | 11111 |

It is noted from the the entries in Table 1 that bits 4 and 5 are each "0" for count states 0–7. Therefore the signals inverted by the inverters 25 and 26 causes a "1" binary logic state to be generated by the AND-gate 29 for count states 0–7 of the counter 23. For count states 8–15 bit 5 is "0" and bit 4 is "1"Therefore the invertor 16 cause the AND-gate 30 to produce a "1" logic state signal for count states 8–15 of the counter 23. For count states 16–23 bit 5 is a "1" and bit 4 is a "0". Therefore the invertor 28 causes the AND-gate 31 to produce a "1" logic state signal for count states 16–23 of the counter 23. For count states 24–31, bits 5 and 4 are both "1". Therefore the AND-gate 32 produces a "1" logic state signal for count states 24–31 of the counter 23.

The data select 21 is implemented by means of the set of AND-gates 33–36 in combination with the OR-gate 37. While only a single line is shown explicitly from each increment generator to an associated AND-gate, this is to be understood to be a graphical abbreviation for a number of signal lines and AND-gates corresponding to the number of bits comprising an increment number.

All five bits of the count state of the counter 23 are inverted by means of the set of invertor gates 38, 39, 40, 51 and 52. Thus the AND-gate 41 for the zero, or minimal, count state of the counter 23.

Figure 4:
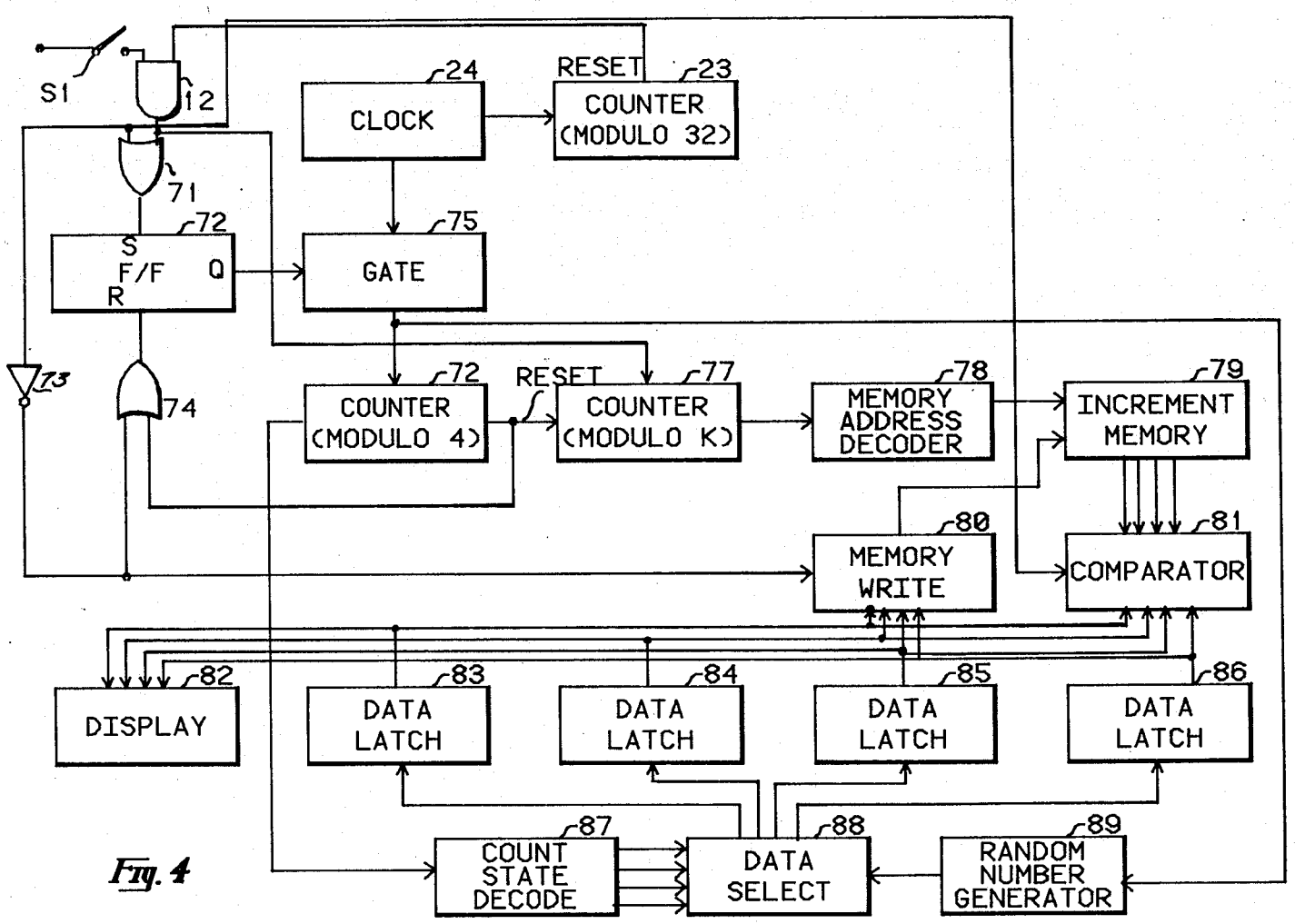
FIG. 4 is a schematic diagram of an alternate embodiment of the invention.

FIG. 4 shows an alternate implementation of the invention in which a random number generator is employed to furnish sets of four increment numbers. This system embodiment is intended for musicians who wish to search for "useful" tones. Each time that a tone, as determined by the generated set of harmonic coefficients, is found to be desirable, a display indicates the corresponding set of four increment numbers so that these can be used in a system configuration such as that shown in FIG. 2 and previously described.

The random number generator 89 generates a sequence of random numbers in response to the timing signals produced by the clock 24 and which are transferred by the gate 75. The random number generator 89 is implemented to generate random numbers which are uniformly distributed in value in the range of −R to R. A good choice for R is R=4 for the system parameters assumed for the illustrative system configuration shown in FIG. 2.

The system shown in FIG. 3 is intended to be incorporated into the system shown in FIG. 2. When the two systems are combined, the increment generators 17–20 are to be replaced by the set of data latches 83–86.

As previously described AND-gate 12 will generate a "1" logic state signal when switch S1 is closed and the RESET signal is generated by the counter 23.

When the flip-flop 72 is set its output is the logic state signal Q="1". In response to the state Q="1", the gate 75 transfers the timing signals produced by the clock 24 to the counter 72. The counter 72 is implemented to count modulo 4. The modulo 4 number is equal to the number of groups in which the 32 harmonics have been partitioned.

The individual count states of the counter 72 are decoded onto four signal lines by means of the count state decoder 87. In response to the decoded count states, the data select 88 transfers the random numbers created by the random number generator 89 to a corresponding one of the set of data latches 83–86.

Each time that the counter 72 is incremented so that it returns to its minimal count state because of its modulo counting implementation, a RESET signal is generated. The counter 77 is incremented in response to the RESET signal generated by the counter 72. Counter 77 is implemented to count modulo K. The modulo number K is chosen to be equal to the number of data address locations in the increment memory 79. The number K represents the maximum number of distinct sets of harmonic coefficients which can be generated by the random selection system. The counter 77 is reset to its minimal count state by means of the "1" binary logic signal produced by the AND-gate 12 at the start of each new generation of a complete set of harmonic coefficients.

The memory address decoder 78 reads out a set of four increment number values stored in the increment memory 79 at an address corresponding to the count state of the counter 77. The set of increment number values read out the increment memory 79 are compared with the current increased number values stored in the data latches 83–86 by means of the comparator 81.

If the comparator 81 finds a match between the two stored sets of increment number values, a logic binary state "1" signal signifies that the current set of increment number stored in the set of data latches 83–86 has already been previously created by the random number generator 89. In response to a "1" signal from the comparator 81, the flip-flop 72 is retained in its set condition thereby permitting a new set of increment number values to be generated and stored in the set of data latches 83–86. In this fashion set of increment number values which have been previously generated are automatically eliminated from being repeated in the sense of being stored in the increment memory 79.

If the comparator 81 does not find a match between the set of increment number values stored in the increment memory 79 and those stored in the set of data latches 83–86, a "0" binary logic state signal is generated by the comparator 81. In response to such a "0" state signal, which is inverted to a "1" state by the INVERTOR-73, the flip-flop 72 is reset therey terminating the generation of any further sets of increment data values until switch S1 is again closed. In response to a "1" signal from the INVERTOR-73, the memory write 80 causes the current increment number values contained in the set of data latches 83–86 to be stored in the increment memory 79 at an address corresponding to the count state of the counter 77.

The display 82 is a digital data display which is used to indicate the new values of the randomly selected sets of increment number values.

The flip-flop 72 is also reset by the RESET signal produced by the counter 72. Flip-flop 72 is set by the "1" signal produced by the comparator 81 at the end of the generation of the set of four increment number produced by the random number generator 89 if these values correspond to the values stored in the increment memory 79 at an address corresponding to the count state of the counter 77.

The user repeatedly actuates switch S1 until a useful tone is generated. At this time the increment number values indicated on the display 82 can be recorded for later use in a system configuration such as that shown in FIG. 2.

Figure 5:
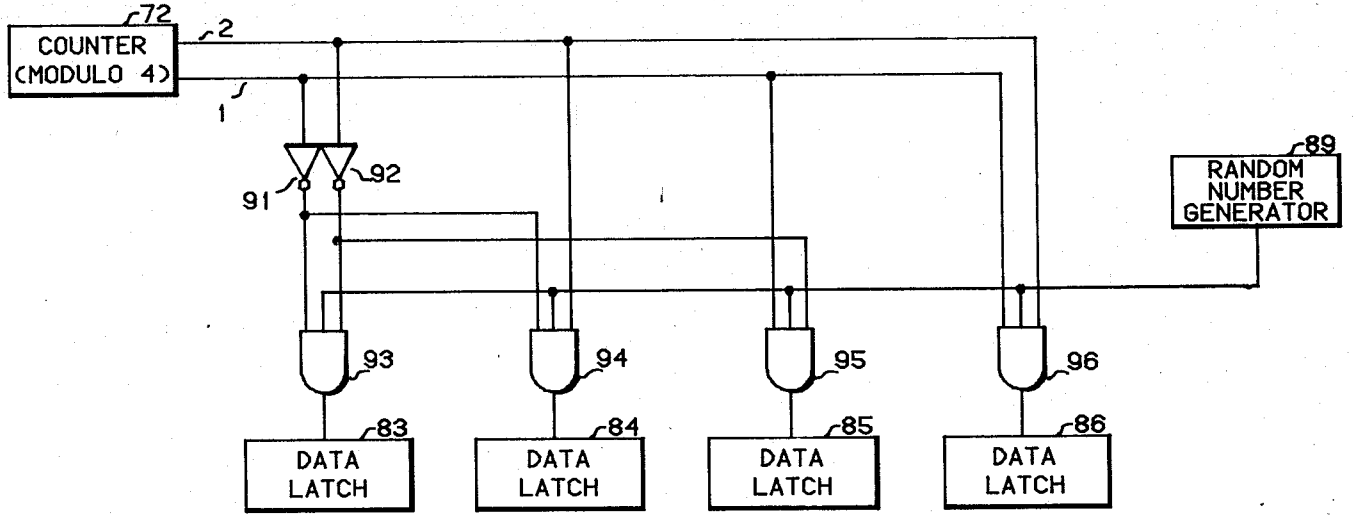
FIG. 5 is a schematic diagram of the count state decode 87 and the data select 88.

FIG. 5 shows the details of the count state decode 87 and the data select 88. The combination of the INVERTOR-gate 91, 92 and the AND-gates 93–94 serve to decode the four count state of the counter 72. The AND-gates 93–96 serve as the data select 88 and transfer the current random number created by the random number generator 89 to a data latch corresponding to the current count state of the counter 72.

While only a single signal line is shown from the output of the random number generator 89 to a set of single AND-gates 93–96, this is to be interpreted as a graphical abbreviation for a larger number of lines and gates corresponding to the number of bits in an increment number value.

It is evident that the invention can readily be incorporated into any digital tone generation system which computes musical waveshapes from a stored set of harmonic coefficients. Another tone generation system of this type is disclosed in U.S. Pat. No. 3,809,786 entitled "Computer Organ." This patent is hereby incorporated by reference. The present invention is incorporated into the Computer Organ of the referenced patent by substituting the coefficient memory 16 of the present FIG. 2 as the harmonic coefficient memory 15 shown in FIG. 1 of U.S. Pat. No. 3,809,786,.

I claim:

1. In combination with a keyboard operated musical instrument having an array of keyboard switches, apparatus for producing musical tones comprising:

an assignor means whereby a detect data word is generated in response to each actuated keyboard switch in said array of keyboard switches and whereby one of a plurality of tone generators is assigned to each actuated keyboard switch and whereby a corresponding detect data word is provided to the corresponding said assigned tone generator, a harmonic coefficient memory for storing a set of harmonic coefficients, a means for generating a plurality of preselected increment numbers, a harmonic coefficient computing means for computing said set of harmonic coefficients in response to said preselected plurality of increment numbers wherein said plurality of increment numbers is less than the number of harmonic coefficients in said set of harmonic coefficients, and whereby said computed set of harmonic coefficients is stored in said harmonic coefficient memory, a memory addressing means for reading out said set of harmonic coefficients from said harmonic coefficient memory, a computing means for computing a sequence of waveshape data points in response to the harmonic coefficients read out of said harmonic coefficient memory, said plurality of tone generators each of which comprises, a conversion means whereby said sequence of waveshape data points is transformed to one of said musical tones at a fundamental frequency corresponding to said provided detect data word.

2. Apparatus according to claim 1 wherein said harominc coefficient computing means comprises;

an initial number generator for creating an initial number, a slope generation means responsive to said plurality of increment numbers and responsive to said initial number whereby a set of harmonic level numbers is generated, and a level conversion means whereby said set of harmonic level numbers are converted to said set of harmonic coefficients which are stored in said harmonic coefficient memory.

3. Apparatus according to claim 2 wherein said increment number generator comprises;

a plurality of increment number memories each one of which stores one of said plurality of increment numbers.

4. Apparatus according to claim 3 wherein said slope generation means comprises;

a clock for providing timing signals, a counter for counting said timing signals modulo a number equal to the number of harmonic coefficients in said set of harmonic coefficients and whereby a reset signal is generated when said counter is incremented to return to its minimal count state, a count state decoder means wherein preselected subsets of the count states of said counter are decoded onto a set of select signal lines wherein each one of said select signal lines corresponds to one of said plurality of increment number memories, a data select means whereby increment numbers stored in said plurality of increment number memories are selected in response to signals on said select signal lines, and an adder-accumulator means, comprising an accumulator, whereby in response to said timing signals said selected increment numbers are successively added to the content of said accumulator to form said set of harmonic level numbers.

5. Apparatus according to claim 4 wherein said slope generation means further comprises;

initializer circuitry means whereby said accumulator is initialized to the value of said initial number in response to said reset signal.

6. Apparatus according to claim 2 wherein said level conversion means comprises;

a conversion memory means for storing a plurality of harmonic coefficient values, and a conversion memory means for reading out a harmonic coefficient value in response to a harmonic level number.

7. Apparatus for generating sets of harmonic coefficients and producing musical tones comprising;

a clock for providing timing signals, a random number generator for generating a plurality of increment numbers in response to said timing signals and in response to a compare signal, a plurality of increment number data latches each one of which stores one of said plurality of increment numbers, a first counter for counting said timing signals modulo a number equal to the number of harmonic coefficients in each said set of harmonic coefficients and whereby a reset signal is generated when said counter is incremented to return to its minimal count state, a second counter for counting each said reset signal modulo the number of said plurality of increment numbers and whereby a second reset signal is generated when said second counter is incremented to return to its minimal count state, a third counter for counting each said second reset signal modulo the number of said sets of harmonic coefficients, an increment number memory for storing sets of said plurality of increment numbers, a memory read means whereby a plurality of increment numbers is read out from said increment number memory in response to the count state of said third counter, a comparator means whereby said compare signal is generated if the plurality of increment numbers stored in said plurality of increment number data latches is equal to the plurality of increment numbers read out from said increment number memory, a memory write means whereby if said compare signal is not generated the plurality of increment numbers stored in said plurality of increment data latches is stored in said increment number memory at a memory address one address number greater than the count state of said third counter, a harmonic coefficient means for generating said set of harmonic coefficients in response to said plurality of increment numbers stored in said increment number memory, and utilization means whereby said musical tones are produced in response to said set of harmonic coefficents.

8. Apparatus according to claim 7 wherein said utilization means comprises;

an array of keyboard switches, an assignor means whereby a detect data word is generated in response to each actuated keyboard switch in said array of keyboard switches and whereby one of a plurality of tone generators is assigned to each actuated keyboard switch and whereby a corresponding detect data word is provided to the corresponding said assigned tone generator, a harmonic coefficient memory for storing a set of harmonic coefficients, a harmonic coefficient generating means for computing said set of harmonic coefficients in response to the plurality of increment numbers stored in said plurality of increment number data latches and whereby said computed set of harmonic coefficients is stored in said harmonic coefficient memory, a memory addressing means for reading out said set of harmonic coefficients from said harmonic coefficient memory, a computing means for computing a sequence of waveshape data points in response to the harmonic coefficients read out of said harmonic coefficient memory, said plurality of tone generators each of which comprises, a conversion means whereby said sequence of waveshape data points is transformed to a musical tone at a fundamental frequency corresponding to said provided detect data word.

* * * * *